US005364721A

United States Patent [19]

Asada et al.

[11] Patent Number: 5,364,721

[45] Date of Patent: * Nov. 15, 1994

[54] ELECTROPHOTOGRAPHIC TONER

[75] Inventors: Hidenori Asada, Hirakata; Takeshi Arakawa, Osaka; Nobuyuki Tsuji, Kakogawa, all of Japan

[73] Assignee: Mita Industrial Co., Ltd., Osaka, Japan

[ * ] Notice: The portion of the term of this patent subsequent to Aug. 31, 2010 has been disclaimed.

[21] Appl. No.: 990,926

[22] Filed: Dec. 15, 1992

Related U.S. Application Data

[63] Continuation of Ser. No. 734,453, Jul. 23, 1991, abandoned.

[30] Foreign Application Priority Data

Jul. 25, 1990 [JP] Japan ..... 2-197369

[51] Int. Cl.[5] ..... G03G 9/087

[52] U.S. Cl. ..... 430/109; 430/904

[58] Field of Search ..... 430/904, 109, 110

[56] References Cited

U.S. PATENT DOCUMENTS

| | | | |
|---|---|---|---|
| 4,486,524 | 12/1984 | Fujisaki et al. | 430/109 |
| 4,499,168 | 2/1985 | Mitsuhashi et al. | 430/99 |
| 4,504,563 | 3/1985 | Tanaka et al. | 430/109 |
| 4,628,019 | 12/1986 | Suematsu et al. | 730/106.6 |
| 4,939,060 | 7/1990 | Tomiyama et al. | 430/106.6 |
| 5,001,031 | 3/1991 | Yamamoto et al. | 430/109 |
| 5,240,805 | 8/1993 | Asada et al. | 430/109 |

FOREIGN PATENT DOCUMENTS

| | | |
|---|---|---|
| 0332212A3 | 10/1989 | European Pat. Off. . |
| 91112498 | 11/1991 | European Pat. Off. . |
| 2091435 | 12/1981 | United Kingdom . |

*Primary Examiner*—Marion E. McCamish
*Assistant Examiner*—Rosemary Ashton
*Attorney, Agent, or Firm*—Beveridge, DeGrandi, Weilacher & Young

[57] ABSTRACT

The present invention provides an electrophotographic toner containing, as a fixing resin, a styrene-acrylic copolymer in which styrene content, molecular-weight distribution and acid value are specified. The electrophotographic toner of the present invention is improved in heat resistance by raising the glass transition temperature of the fixing resin, while assuring excellent low-temperature fixing properties and resistance to off-set.

3 Claims, 1 Drawing Sheet

ELECTROPHOTOGRAPHIC TONER

This application is a continuation of application Ser. No. 07/734,453, filed Jul. 23, 1991, now abandoned, which application is entirely incorporated herein by reference.

BACKGROUND OF THE INVENTION

The present invention relates to an electrophotographic toner and more particularly to an electrophotographic toner to be used for an image forming apparatus such as an electrostatic copying apparatus, a laser beam printer or the like.

In the image forming apparatus above-mentioned, a developer containing an electrophotographic toner is first held around the outer periphery of a developing sleeve incorporating magnetic polarities, thereby to form a so-called magnetic brush. Then, the magnetic brush is let to come in contact with a photoreceptor on the surface of which an electrostatic latent image is being formed, so that the electrophotographic toner is electrostatically sticked to the electrostatic latent image. This causes the electrostatic latent image to be turned into a toner image. Then, the toner image is transferred to paper from the surface of the photoreceptor and fixed on the paper by fixing rollers. Thus, an image corresponding to the electrostatic latent image is formed on the paper.

As the electrophotographic toner, there may be used an electrophotographic toner as obtained by blending a fixing resin with a coloring agent such as carbon black, a charge controlling agent and the like and by pulverizing the blended body into particles having sizes in a predetermined range.

The electrophotographic toner above-mentioned may present the problem of so-called off-set such as contamination of paper at the reverse side thereof or contamination of the fixing rollers due to toner falling from the paper. In particular, when the fixing temperature is low, the toner image might not be satisfactorily fixed onto the paper (deterioration of fixing properties at a low temperature).

Of the problems above-mentioned, the deterioration of fixing properties at a low temperature occurs mainly when the molecular weight of the fixing resin contained in the electrophotographic toner is high. On the other hand, the off-set occurs mainly when the molecular weight of the fixing resin is low.

To overcome the problems above-mentioned, there have been proposed various examples of the electrophotographic toner jointly containing resin having low molecular weight and resin having high molecular weight (See, for example, Japanese Patent Unexamined Publications No. 16144/1981 and No. 3644/1985).

A conventional electrophotographic toner is not provided with sufficient heat resistance. Accordingly, when the conventional electrophotographic toner is used for a low-speed image forming apparatus in which temperature is raised to a high temperature, the toner is blocked to provoke toner blanking, a so-called rainfall phenomenon, defective cleaning and the like. The toner blanking refers to the phenomenon that giant toner particles produced as agglomerated due to blocking are caught in the space between the photoreceptor and paper to form gaps therearound, thus preventing the toner from being transferred to the paper, thereby to leave white portions on the resulting image. The "rainfall" refers to the phenomenon that toner molten and sticked to the surface of the photoreceptor drum due to blocking leave traces in the form of stripes on the resulting image. The defective cleaning refers to the phenomenon that blocked toner is sticked to the blade for cleaning the photoreceptor drum. Such defective cleaning may cause the toner blanking or "rainfall" above-mentioned.

SUMMARY OF THE INVENTION

It is a main object of the present invention to provide an electrophotographic toner excellent in fixing properties at a low temperature and resistance to off-set, as well as heat resistance.

To achieve the object above-mentioned, the inventors of the present invention have studied the relationship between the physical properties of a styrene-acrylic copolymer serving as a fixing resin and the heat resistance of the electrophotographic toner, and found that the toner could be improved in heat resistance when the glass transition temperature of the fixing resin was raised. The inventors have further studied a method of raising the glass transition temperature of the fixing resin without injuring the fixing properties at a low temperature and resistance to off-set, and found the following fact. That is, when the molecular-weight distribution of the styrene-acrylic copolymer is limited to a predetermined range and the content of styrene is increased to raise the glass transition temperature, the toner can be improved in heat resistance, yet assuring good fixing properties at a low temperature and good resistance to off-set. Based on the finding above-mentioned, the inventors have now accomplished the present invention.

According to a first embodiment of the present invention, there is provided an electrophotographic toner which contains, as the fixing resin, a styrene-acrylic copolymer containing styrene in an amount of not less than 80% by weight with respect to the entire resin amount and presenting a gel permeation chromatogram of molecular-weight distribution in which the maximum value is located in each of ranges from not less than $1\times10^3$ to less than $1\times10^5$ and from not less than $1\times10^5$ to not greater than $2\times10^5$, and of which upper limit is $2.1\times10^5$.

The inventors have further studied and found that, when the molecular-weight distribution of the styrene-acrylic copolymer was limited to a predetermined range and the intermolecular crosslinking in the styrene-acrylic copolymer was increased in amount to raise the glass transition temperature, the toner could be improved in heat resistance, yet assuring the fixing properties at a low temperature and resistance off-set as above-mentioned. The amount of the intermolecular crosslinking in the styrene-acrylic copolymer is determined by an acid value which refers to the amount in mg of potassium hydroxide (KOH) required for neutralizing free fatty acid contained in 1 gram of the styrene-acrylic copolymer. To specify the range of the acid value, the inventors have continuously studied the styrene-acrylic copolymer with the determination of the molecular-weight distribution thereof taken into consideration, and now accomplished the present invention.

According to a second embodiment of the present invention, there is provided an electrophotographic toner containing, as the fixing resin, a styrene-acrylic copolymer which contains styrene in a range from 40 to 80% by weight with respect to the entire resin amount, in which the acid value is in a range from 20 to 50 mg/g, and which presents a gel permeation chromatogram of molecular-weight distribution in which the maximum value is located in each of ranges from not less than $1\times10^3$ to less than $1\times10^5$ and from not less than $1\times10^5$ to not greater than $3\times10^5$.

According to the second embodiment of the present invention, when treating the surfaces of the toner particles with a surface treating agent, it is preferable to jointly use an alumina-type surface treating agent and a hydrophilic or hydrophobic silica-type surface treating agent.

DETAILED DESCRIPTION OF THE INVENTION

According to the first embodiment of the present invention, the content of styrene in the entire resin is limited to not less than 80% by weight. This is because, if such a content is less than 80% by weight, the glass transition temperature of the fixing resin is not sufficiently increased, thus failing to improve the toner in heat resistance.

According to the second embodiment of the present invention, the acid value of the styrene-acrylic copolymer is limited to the range from 20 to 50 mg/g for the reason set forth below. If the acid value of the styrene-acrylic copolymer is less than 20 mg/g, the glass transition temperature of the fixing resin is not sufficiently increased, thus failing to improve the toner in heat resistance. On the other hand, if the acid value of the styrene-acrylic copolymer exceeds 50 mg/g, this results in the presence of a great amount of functional group in the fixing resin to deteriorate the toner in humidity resistance.

To adjust the acid value of the styrene-acrylic copolymer in the range above-mentioned, it is enough to adjust the ratio (by amount) of acrylate and acrylic acid in the acrylic component of the copolymer.

When the acid value of the styrene-acrylic copolymer is limited to the range above-mentioned, the fixing resin should contain styrene in a range of 40 to 80% by weight. If the styrene contents is less than 40% by weight, the glass transition temperature of the fixing resin is not sufficiently increased, thus failing to improve the toner in heat resistance. If the content of styrene in the resin exceeds 80% by weight, this relatively reduces the amount of the acrylic component containing a —COO— group or the like which affects the electric charging characteristics of the toner. Accordingly, the toner is decresed in electric charging characteristics to provoke the decrease in image density, fog due to toner scattering and the like. More preferably, the content of styrene in the resin is in a range from 60 to 80% by weight.

Figure 1:
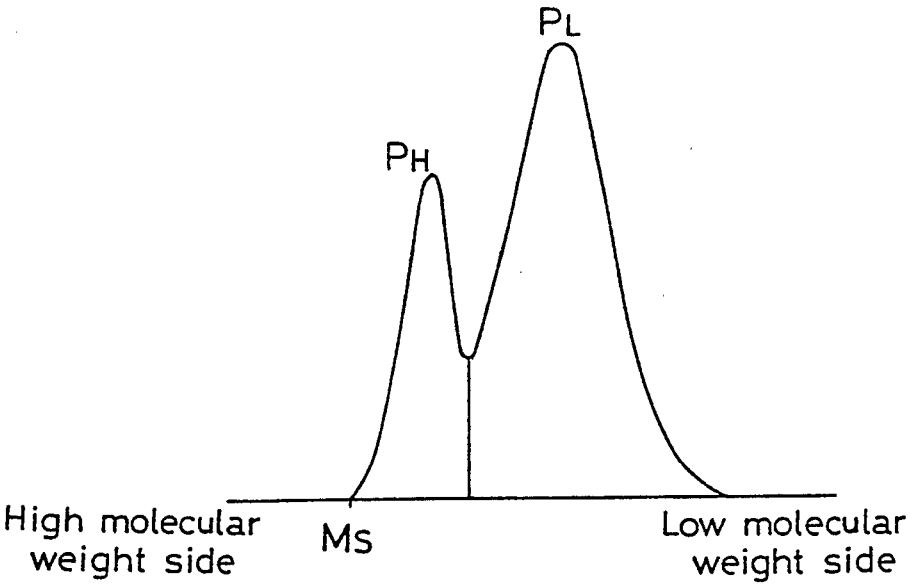
FIG. 1 is a gel permeation chromatogram showing an example of the molecular-weight distribution of a styrene-acrylic copolymer.

There may be used, as the styrene-acrylic copolymer serving as a toner fixing resin, a copolymer presenting a gel permeation chromatogram of molecular-weight distribution as shown in FIG. 1 in which maximum values $P_H$ and $P_L$ are respectively located in the high-molecular-weight side and the low-molecular-weight side. Another maximum value may be further located between both maximum values $P_H$ and $P_L$.

According to the first embodiment of the present invention, the molecular weight of the maximum value $P_H$ at the high-molecular-weight side is limited to a range from not less than $1\times10^5$ to not greater than $2\times10^5$. If the molecular weight of the maximum value $P_H$ is less than $1\times10^5$, the high-molecular-weight component in the styrene-acrylic copolymer is insufficient in amount, thus failing to produce a toner excellent in resistance to off-set. On the other hand, if the molecular weight of the maximum value $P_H$ exceeds $2\times10^5$, this results in the presence of a great amount of the high-molecular-weight component which is liable to be cut upon reception of heat or mechanical shear force. Therefore, the heat resistance is rather deteriorated. Preferably, the molecular weight of the maximum value $P_H$ at the high-molecular-weight component side is in a range from $1.5\times10^5$ to $1.9\times10^5$.

According to the first embodiment of the present invention, the upper limit $M_S$ of the molecular-weight distribution is limited to $2.1\times10^5$. The high-molecular-weight component of which molecular weight exceeds $2.1\times10^5$, is liable to be cut upon reception of heat or mechanical shear force, thereby to deteriorate the fixing resin in heat resistance.

According to the second embodiment of the present invention, the styrene component causing the copolymer to be readily cut may be reduced in amount to the range of 40–80% by weight as mentioned earlier. Together with the presence of a great amount of intermolecular crosslinking, such reduction causes the styrene-acrylic copolymer to be cut with difficulty due to heat or mechanical shear force. It is therefore possible to increase the upper limit of the molecular weight of the maximum value $P_H$ at the high-molecular-weight side up to $3\times10^5$. However, if the molecular weight of the maximum value $P_H$ exceeds $3\times10^5$, the high-molecular-weight component liable to be cut upon reception of heat or mechanical shear force is increased in amount. In this connection, the molecular weight of the maximum value $P_H$ at the high-molecular-weight side should be not greater than $3\times10^5$. It is noted that the lower limit of the molecular weight of the maximum value $P_H$ at the high-molecular-weight side is $1\times10^5$ as in the first embodiment. Preferably, the molecular weight of the maximum value $P_H$ at the high-molecular-weight side is in a range from $1.5\times10^5$ to $2.5\times10^5$.

According to each of the first and second embodiments of the present invention, the molecular weight of the maximum value $P_L$ at the low-molecular-weight side is limited to a range from not less than $1\times10^3$ to less than $1\times10^5$. If the molecular weight of the maximum value $P_L$ is not less than $1\times10^5$, the amount of the low-molecular-weight component in the styrene-acrylic copolymer is too insufficient to obtain a toner excellent in fixing properties at a low temperature. On the other hand, if the molecular weight of the maximum value $P_L$ is less than $1\times10^3$, the shape retention of the styrene-acrylic copolymer is too insufficient to obtain a toner excellent in durability. Preferably, the molecular weight of the maximum value $P_L$ at the low-molecular-weight side is in a range from $2\times10^3$ to $1\times10^4$.

The styrene-acrylic copolymer may be produced either by uniformly melting and blending a plurality of types of styrene-acrylic copolymers having different molecular-weight distributions or by using a two-stage polymerization, such that the resultant styrene-acrylic copolymer has the molecular-weight distribution above-mentioned.

Figure 2:
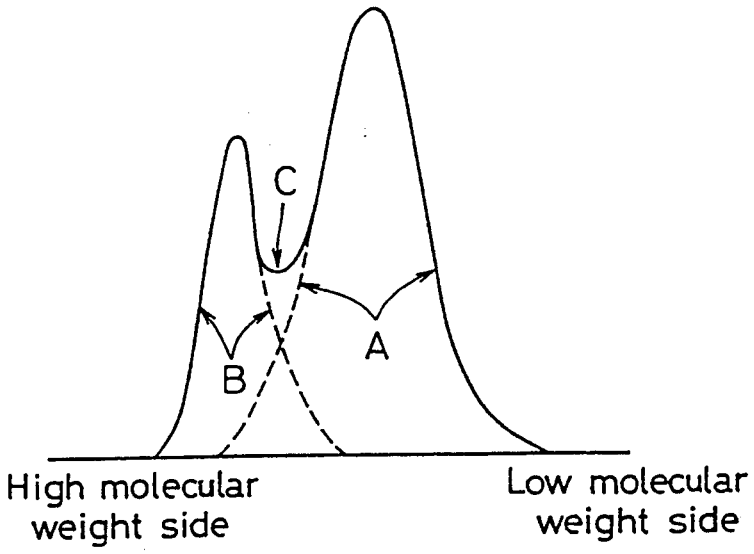
FIG. 2 is a gel permeation chromatogram showing an example of a method of obtaining a styrene-acrylic copolymer presenting the molecular-weight distribution shown in FIG. 1.

For example, as shown in FIG. 2, when there are molten and blended, in the same amount, a styrene-acrylic copolymer (low-molecular-weight component) having a molecular-weight distribution shown by a curve A and a styrene-acrylic copolymer (high-molecular-weight component) having a molecular-weight distribution shown by a curve B, there is obtained a styrene-acrylic copolymer having a molecular-weight distribution as shown by a curve C.

According to a suspension polymerization or an emulsion polymerization, a polymer having a high molecular weight may be generally more easily produced as compared with a solution polymerization. Accordingly, the styrene-acrylic copolymer having the molecular-weight distribution above-mentioned may be produced by a multi-stage polymerization in which the suspension polymerization or the emulsion polymerization and the solution polymerization are combined in this order or in the reverse order with the molecular weight adjusted at each stage. The molecular weight or molecular-weight distribution may be adjusted by suitably selecting the type or amount of an initiator, the type of a solvent, a dispersing agent or an emulsifying agent relating to chain transfer, and the like.

As a styrene monomer, there may be used vinyl-toluene, α-methylstyrene or the like, besides styrene. As an acrylic monomer, there may be used a monomer represented by the following general formula (I):

$$CH_2{=}\overset{\overset{R^1}{|}}{C}{-}CO{-}O{-}R^2 \qquad (I)$$

wherein $R^1$ is a hydrogen atom or a lower alkyl group, $R^2$ is a hydrogen atom, a hydrocarbon group having 1 to 12 carbon atoms, a hydroxyalkyl group, a vinylester group or an aminoalkyl group.

Examples of the acrylic monomer represented by the general formula (I), include acrylic acid, methacrylic acid, methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, ethyl β-hydroxyacrylate, propyl γ-hydroxyacrylate, butyl δ-hydroxyacrylate, ethyl β-hydroxymethacrylate, propyl γ-aminoacrylate, propyl γ-N,N-diethylaminoacrylate, ethylene glycol dimethacrylate, tetraethylene glycol dimethacrylate and the like.

The most suitable styrene-acrylic copolymer is a styrene/butyl acrylate copolymer. There may be preferably used a styrene/butyl acrylate copolymer containing 50 to 90% by weight of styrene and 10 to 50% by weight of butyl acrylate.

The toner may be produced by blending the fixing resin above-mentioned with additives such as a coloring agent, a charge controlling agent, a release agent (offset preventing agent) and the like, and by pulverizing the blended body into particles having suitable particle sizes.

Examples of the coloring agent include a variety of a coloring pigment, an extender pigment, a conductive pigment, a magnetic pigment, a photoconductive pigment and the like. The coloring agent may be used alone or in combination of plural types according to the application.

The following examples of the coloring pigment may be suitably used.

Black
- Carbon black such as furnace black, channel black, thermal, gas black, oil black, acetylene black and the like, Lamp black, Aniline black White
- Zinc white, Titanium oxide, Antimony white, Zinc sulfide Red
- Red iron oxide, Cadmium red, Red lead, Mercury cadmium sulfide, Permanent red 4R, Lithol red, Pyrazolone red, Watching red calcium salt, Lake red D, Brilliant carmine 6B, Eosine lake, Rhodamine lake B, Alizarine lake, Brilliant carmine 3B Orange
- Chrome orange, Molybdenum orange, Permanent orange GTR, Pyrazolone orange, Vulcan orange, Indanthrene brilliant orange RK, Benzidine orange G, Indanthrene brilliant orange GK Yellow
- Chrome yellow, Zinc yellow, Cadmium yellow, Yellow iron oxide, Mineral fast yellow, Nickel titanium yellow, Naples yellow, Naphthol yellow S, Hansa yellow 10G, Benzidine yellow G, Benzidine yellow GR, Quinoline yellow lake, Permanent yellow NCG, Tartrazine lake Green
- Chrome green, Chromium oxide, Pigment green B, Malachite green lake, Fanal yellow green G Blue
- Prussian blue, Cobalt blue, Alkali blue lake, Victoria blue lake, Partially chlorinated phthalocyanine blue, Fast sky blue, Indanthrene blue BC Violet
- Manganese violet, Fast violet B, Methyl violet lake Examples of the extender pigment include Baryte powder, barium carbonate, clay, silica, white carbon, talc, alumina white.

Examples of the conductive pigment include conductive carbon black, aluminium powder and the like.

Examples of the magnetic pigment include a variety of ferrites such as triiron tetroxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_4$), copper iron oxide ($CuFe_2O_4$), lead iron oxide ($PbFe_{12}O_{19}$), neodymium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder, cobalt powder, nickel powder and the like.

Examples of the photoconductive pigment include zinc oxide, selenium, cadmium sulfide, cadmium selenide and the like.

The coloring agent may be contained in an amount from 1 to 30 parts by weight and preferably from 2 to 20 parts by weight for 100 parts by weight of the fixing resin.

As the electric charge controlling agent, there may be used either one of two different electric charge controlling agents of the positive charge controlling type and the negative charge controlling type, according to the toner polarity.

As the electric charge controlling agent of the positive charge controlling type, there may be used an organic compound having a basic nitrogen atom such as a basic dye, aminopyrine, a pyrimidine compound, a polynuclear polyamino compound, aminosilane, a filler of which surface is treated with any of the substances above-mentioned.

As the electric charge controlling agent of the negative charge controlling type, there may be used a compound containing a carboxy group (such as metallic chelate alkyl salicylate or the like), a metal complex salt dye, fatty acid soap, metal salt naphthenate or the like.

The electric charge controlling agent may be preferably used in an amount from 0.1 to 10 parts by weight and more preferably from 0.5 to 8 parts by weight for 100 parts by weight of the fixing resin.

Examples of the release agent (off-set preventing agent) include aliphatic hydrocarbon, aliphatic metal salts, higher fatty acids, fatty esters, its partially saponified substances, silicone oil, waxes and the like. Of these, there is preferably used aliphatic hydrocarbon of which weight-average molecular weight is from 1,000 to 10,000. More specifically, there is suitably used one or a combination of plural types of low-molecular-weight polypropylene, low-molecular-weight polyethylene, paraffin wax, a low-molecular-weight olefin polymer composed of an olefin monomer having 4 or more carbon atoms and the like.

The release agent may be used in an amount from 0.1 to 10 parts by weight and preferably from 0.5 to 8 parts by weight for 100 parts by weight of the fixing resin.

The toner is produced by a method of previously mixing the components above-mentioned uniformly with the use of a dry blender, a Henschel mixer, a ball mill or the like, uniformly melting and kneading the resultant mixture with the use of a kneading device such as a Banbury mixer, a roll, a single- or double-shaft extruding kneader or the like, cooling and grinding the resultant kneaded body, and classifying the resultant ground pieces as necessary. The toner may also be produced by suspension polymerization or the like.

The toner particle size is preferably from 3 to 35 μm and more preferably from 5 to 25 μm.

To improve the flowability and electric charging characteristics, the toner may be covered at the surface thereof with any of conventional surface treating agents such as inorganic fine particles, fluoroplastic particles and the like. Preferably, there may be used a silica-type surface treating agent containing hydrophilic or hydrophobic silica fine particles such as silica anhydride in the form of microfine particles, coloidal silica or the like.

According to the second embodiment of the present invention, when using the silica-type surface treating agent, it is preferable to jointly use an alumina-type surface treating agent. More specifically, the fixing resin used for the toner of the second embodiment presents a high acid value and contains a great amount of —COOH which is a functional group of negative polarity. Accordingly, the alumina-type surface treating agent liable to be positively charged is dispersed more readily than the silica-type surface treating agent liable to be negatively charged. Accordingly, the joint use of the alumina-type surface treating agent can enhance the dispersion of the surface treating agents in their entirety. This results in further improvement in such improved effects of flowability and electric charging characteristics as would be obtained by addition of a surface treating agents.

When jointly using the alumina-type surface treating agent and the silica-type surface treating agent, it is preferable to treat the toner firstly with the alumina-type surface treating agent excellent in dispersion and secondly with the silica-type surface treating agent. If the treating order above-mentioned is reversed or both alumina- and silica-type surface treating agents are used at the same time, this involves the likelihood to lower such improved effects of flowability and electric charging characteristics as would be obtained by addition of a surface treating agent.

The toner as mixed with a magnetic carrier such as ferrite, iron powder or the like may be used as a two-component developer for an image forming apparatus.

According to the first embodiment of the present invention, the molecular-weight distribution of the styrene-acrylic copolymer is limited to a predetermined range to assure good fixing properties at a low temperature and resistance to off-set, and the content of styrene is increased to raise the glass transition temperature of the fixing resin. Thus, according to the first embodiment, there may be obtained an electrophotographic toner excellent in fixing properties at a low temperature and resistance to off-set, as well as heat resistance.

According to the second embodiment of the present invention, the molecular-weight distribution of the styrene-acrylic copolymer is limited to a predetermined range to assure good fixing properties at a low temperature and resistance to off-set, and the amount of the intermolecular crosslinking in the styrene-acrylic copolymer is increased to raise the glass transition temperature of the fixing resin. Thus, according to the second embodiment, there may be obtained an electrophotographic toner excellent in fixing properties at a low temperature and resistance to off-set, as well as heat resistance.

EXAMPLES

The following description will discuss the present invention with reference to Examples thereof and Comparative Examples.

EXAMPLE 1

There were mixed (i) 100 parts by weight of a styrene (St)/butyl acrylate (BA) copolymer [St:BA=85:15 (ratio by weight)] having the following molecular-weight distribution, (ii) 8 parts by weight of carbon black as the coloring agent, (iii) 1 part by weight of a negative-polarity dye as the charge controlling agent, and (iv) 1 part by weight of low molecular-weight polypropylene as the off-set preventing agent. After molten and kneaded, the resulting mixture was cooled, ground and classified to produce an electrophotographic toner having a volumetric median diameter of 12 μm.

Molecular-Weight Distribution:

1) Upper limit $M_S$ of the molecular-weight distribution: 210000.

2) Molecular weight of the maximum value $P_H$:191000

3) Molecular weight of the maximum value $P_L$:5000

EXAMPLE 2

There was prepared an electrophotographic toner in the same manner as in Example 1, except for the use of 100 parts by weight of a styrene(St)/butyl acrylate (BA) copolymer [St:BA =90:10 (ratio by weight)] having the following molecular-weight distribution, instead of 100 parts by weight of the copolymer used in Example 1.

Molecular-Weight Distribution:

1) Upper limit $M_S$ of the molecular-weight distribution: 210000

2) Molecular weight of the maximum value $P_H$:180000

3) Molecular weight of the maximum value $P_L$:5000

Comparative Example 1

There was prepared an electrophotographic toner in the same manner as in Example 1, except for the use of 100 parts by weight of a styrene(St)/butyl acrylate (BA) copolymer [St:BA =75:25 (ratio by weight)] having the following molecular-weight distribution, instead of 100 parts by weight of the copolymer used in Example 1.

Molecular-Weight Distribution:

1 ) Upper limit $M_S$ of the molecular-weight distribution: 210000

Molecular weight of the maximum value $P_H$:191000

Molecular weight of the maximum value $P_L$:5000

Comparative Example 2

There was prepared an electrophotographic toner in the same manner as in Example 1, except for the use of 100 parts by weight of a styrene(St)/butyl acrylate (BA) copolymer [St:BA =85:15 (ratio by weight)] having the following molecular-weight distribution, instead of 100 parts by weight of the copolymer used in Example 1.

Molecular-Weight Distribution:

1) Upper limit $M_S$ of the molecular-weight distribution: 225000

Molecular weight of the maximum value $P_H$:210000

Molecular weight of the maximum value $P_L$:5000

Comparative Example 3

There was prepared an electrophotographic toner in the same manner as in Example 1, except for the use of 100 parts by weight of a styrene(St)/butyl acrylate (BA) copolymer [St:BA =85:15 (ratio by weight)] having the following molecular-weight distribution, instead of 100 parts by weight of the copolymer used in Example 1.

Molecular-Weight Distribution:

1) Upper limit $M_S$ of the molecular-weight distribution: 210000

2) Molecular weight of the maximum value $P_H$:80000

3) Molecular weight of the maximum value $P_L$:5000

Comparative Example 4

There was prepared an electrophotographic toner in the same manner as in Example 1, except for the use of 100 parts by weight of a styrene(St)/butyl acrylate (BA) copolymer [St:BA =85:15 (ratio by weight)] having the following molecular-weight distribution, instead of 100 parts by weight of the copolymer used in Example 1.

Molecular-Weight Distribution:

1) Upper limit $M_S$ of the molecular-weight distribution: 210000

2) Molecular weight of the maximum value $P_H$:191000

3) Molecular weight of the maximum value $P_L$:110000

0.2 Part by weight of hydrophobic silica was mixed with 100 parts by weight of each of the electrophotographic toners of Examples 1, 2 and Comparative Examples 1 to 4. A ferrite carrier having the average particle size of 80 μm was then blended with each of the resultant mixtures, and uniformly agitated and mixed to prepare a two-component developer having toner density of 4.0%. With the use of each of the developers thus prepared, the following tests were conducted.

Measurement of Initial Image Density

With an electrophotographic copying apparatus (DC-2055 manufactured by Mita Industrial Co., Ltd. ) using each of the developers above-mentioned, a black-solid document was copied. Then, the initial image density (I.D.) of each of the copied pieces was measured with a reflection densitometer (Model TC-6D manufactured by Tokyo Denshoku Co., Ltd.).

Measurement of Fog Density

With the electrophotographic copying apparatus above-mentioned using each of the electrophotographic toners above-mentioned, a black-white document was continuously copied for 20,000 pieces. Then, with the reflection densitometer above-mentioned, the density of the blank portion of each of the 20,000th copied images was measured and defined as fog density (F.D.)

Test of Fixing Properties

While the temperature set to the heating rollers of an electrophotographic copying apparatus (Modified Type of DC-2055 manufactured by Mita Industrial Co., Ltd.) (of the heating pressure roller fixing type) was raised in steps of 2.5° C. from 140° C., paper having thereon a toner image corresponding to a solid-black document was passed in the apparatus, causing the image to be fixed. An adhesive tape was pressingly contacted with each fixed image and then separated. The density data of each fixed image before and after separation were measured with the reflection densitometer above-mentioned. According to the following equation, there was obtained the lowest temperature at which the fixing ratio exceeded 90%. The temperature thus obtained was defined as the lowest fixing temperature ($F_1$).

Fixing ratio (%)=(Image density after separation/Image density before separation)×100

While the roller temperature was further raised, there was obtained the temperature at which off-set occurred. The temperature thus obtained was defined as a high-temperature off-set generating temperature ($F_2$).

Test of Resistance to Blocking

First, 20 g of each toner was put in a glass cylinder having an inner diameter of 26.5 mm in an oven with a predetermined temperature. A weight of 100 g was placed on the toner, which was then left for 30 minutes. Then, the cylinder was pulled out and the toner state was observed. There was recorded the oven temperature ($B_1$) at which each toner did not finally collapsed.

Observation of Toner Blanking

There was prepared a mesh chart in which 30 mesh patterns were being attached on the surface of white paper having a A4 size, each mesh pattern containing a plurality of parallel straight lines which were transversely and longitudinally drawn at regular intervals of about 0.57 mm in a regular square of which each side had a length of 24 mm. As a document, this mesh chart was copied with the copying appratus above-mentioned using each of the developers above-mentioned. Five copied pieces were sampled at each of seven times, i.e., the starting, 500th, 1,000th, 2,000th, 3,000th, 4,000th and 5,000th times. All the extracted copies were checked for toner blanking and evaluated according to the following standards.

O: Presence of not greater than 9 blankings

X: Presence of not less than 10 blankings

Observation of "Rainfall"

A solid-black document was continuously copied for 20,000 pieces with the use of each of the developers abov-mentioned. Each 20,000th copied piece was checked for "rainfall".

O: No "rainfall" observed

X: "Rainfall" observed

The results of the tests and ovservations above-mentioned are shown in Tables 1A and 1B.

TABLE 1A

| | I.D. | F.D. | $F_1$ °C. | $F_2$ °C. |
|---|---|---|---|---|
| Example 1 | 1.4 | 0.000 | 145 | 190 |
| Example 2 | 1.4 | 0.000 | 145 | 190 |
| Comparative Example 1 | 1.4 | 0.005 | 140 | 180 |
| Comparative Example 2 | 1.4 | 0.004 | 145 | 180 |
| Comparative Example 3 | 1.4 | 0.000 | 140 | 140 |
| Comparative Example 4 | 1.4 | 0.000 | 160 | 185 |

TABLE 1B

| | $B_1$ °C. | Toner Blanking | "Rainfall" |
|---|---|---|---|
| Example 1 | 70 | ○ | ○ |
| Example 2 | 70 | ○ | ○ |
| Comparative Example 1 | 60 | X | X |
| Comparative Example 2 | 60 | X | X |
| Comparative Example 3 | 65 | X | X |
| Comparative Example 4 | 70 | ○ | ○ |

As apparent from Tables 1A and 1B, it was found that, in each of Comparative Example 1 containing styrene in an amount less than 80% by weight, Comparative Example 2 in which the molecular-weight distribution upper limit $M_S$ exceeded $2.1\times10^5$ and Comparative Example 3 in which the molecular weight of the maximum value $P_H$ was less than $1\times10^5$, the blocking temperature was low so that both toner blanking and "rainfall" due to toner blocking were observed. It was also found that, in Comparative Example 3 in which the molecular weight of the maximum value $P_H$ was less than $1\times10^5$, the high-temperature off-set temperature was low to readily produce off-set. It was also found that Comparative Example 4 in which the molecular weight of the maximum value $P_L$ exceeded $1\times10^5$, was low in lowest fixing temperature and therefore disadvantageous in low-temperature fixing properties. It was also found that, in each of Comparative Examples 1 and 2, there was observed fog due to unstable electric charging characteristics. On the other hand, it was also found that each of Examples 1 and 2 in accordance with the present invention was excellent in resistance to off-set and resistance to blocking.

EXAMPLE 3

There were mixed (i) 100 parts by weight of a styrene (St)/butyl acrylate (BA) copolymer [St :BA=70:30 (ratio by weight), acid value of 30 mg/g] having the following molecular-weight distribution, (ii) 8 parts by weight of carbon black as the coloring agent, (iii) 1 part by weight of a negative-polarity dye as the charge controlling agent, and (iv) 1 part by weight of low molecular-weight polypropylene as the off-set preventing agent. After molten and kneaded, the resulting mixture was cooled, ground and classified to produce an electrophotographic toner having a volumetric median diameter of 12 μm.

Molecular-Weight Distribution:

1) Molecular weight of the maximum value $P_H$:230000

2 ) Molecular weight of the maximum value $P_L$:5000

EXAMPLE 4

There was prepared an electrophotographic toner in the same manner as in Example 3, except for the use of 100 parts by weight of a styrene(St)/butyl acrylate (BA) copolymer [St:BA=75:25 (ratio by weight, acid value of 25 mg/g] having the following molecular-weight distribution, instead of 100 parts by weight of the copolymer used in Example 3.

Molecular-Weight Distribution:

1) Molecular weight of the maximum value $P_H$:240000

2) Molecular weight of the maximum value $P_L$:5000

EXAMPLE 5

There was prepared an electrophotographic toner in the same manner as in Example 3, except for the use of 100 parts by weight of a styrene(St)/butyl acrylate (BA) copolymer [St:BA =50:50 (ratio by weight), acid value of 40 mg/g] having the following molecular-weight distribution, instead of 100 parts by weight of the copolymer used in Example 3.

Molecular-Weight Distribution:

1) Molecular weight of the maximum value $P_H$:240000

2) Molecular weight of the maximum value $P_L$:5000

Comparative Example 5

There was prepared an electrophotographic toner in the same manner as in Example 3, except for the use of 100 parts by weight of a styrene(St)/butyl acrylate (BA) copolymer [St:BA=30:70 (ratio by weight), acid value of 30 mg/g] having the following molecular-weight distribution, instead of 100 parts by weight of the copolymer used in Example 3.

Molecular-Weight Distribution:

1) Molecular weight of the maximum value $P_H$:240000

2) Molecular weight of the maximum value $P_L$:5000

Comparative Example 6

There was prepared an electrophotographic toner in the same manner as in Example 3, except for the use of 100 parts by weight of a styrene(St)/butyl acrylate (BA) copolymer [St:BA=90:10 (ratio by weight), acid value of 25 mg/g] having the following molecular-weight distribution, instead of 100 parts by weight of the copolymer used in Example 3.

Molecular-Weight Distribution:

1) Molecular weight of the maximum value $P_H$:240000

2) Molecular weight of the maximum value $P_L$:5000

Comparative Example 7

There was prepared an electrophotographic toner in the same manner as in Example 3, except for the use of 100 parts by weight of a styrene(St)/butyl acrylate (BA) copolymer [St:BA=70:30 (ratio by weight), acid value of 15 mg/g ] having the following molecular-weight distribution, instead of 100 parts by weight of the copolymer used in Example 3.

Molecular-Weight Distribution:

1) Molecular weight of the maximum value $P_H$:240000

2) Molecular weight of the maximum value $P_L$:5000

Comparative Example 8

There was prepared an electrophotographic toner in the same manner as in Example 3, except for the use of 100 parts by weight of a styrene(St)/butyl acrylate (BA) copolymer [St:BA=70:30 (ratio by weight), acid value of 60 mg/g] having the following molecular-weight distribution, instead of 100 parts by weight of the copolymer used in Example 3.

Molecular-Weight Distribution:

1) Molecular weight of the maximum value $P_H$:240000

2) Molecular weight of the maximum value $P_L$:5000

Comparative Example 9

There was prepared an electrophotographic toner in the same manner as in Example 3, except for the use of 100 parts by weight of a styrene(St)/butyl acrylate (BA) copolymer [St:BA=70:30 (ratio by weight), acid value of 30 mg/g ] having the following molecular-weight distribution, instead of 100 parts by weight of the copolymer used in Example 3.

Molecular-Weight Distribution:

1) Molecular weight of the maximum value $P_H$:80000

2) Molecular weight of the maximum value $P_L$:5000

Comparative Example 10

There was prepared an electrophotographic toner in the same manner as in Example 3, except for the use of 100 parts by weight of a styrene(St)/butyl acrylate (BA) copolymer [St:BA=70:30 (ratio by weight), acid value of 30 mg/g] having the following molecular-weight distribution, instead of 100 parts by weight of the copolymer used in Example 3.

Molecular-Weight Distribution:

1) Molecular weight of the maximum value $P_H$:240000

2) Molecular weight of the maximum value $P_L$:110000

Comparative Example 11

There was prepared an electrophotographic toner in the same manner as in Example 3, except for the use of 100 parts by weight of a styrene(St)/butyl acrylate (BA) copolymer [St:BA=85:15 (ratio by weight), acid value of 30 mg/g] having the following molecular-weight distribution, instead of 100 parts by weight of the copolymer used in Example 3.

Molecular-Weight Distribution:

1) Molecular weight of the maximum value $P_H$:240000

2) Molecular weight of the maximum value $P_L$:5000

0.2 Part by weight of hydrophobic silica was mixed with 100 parts by weight of each of the electrophotographic toners of Examples 3 to 5 and Comparative Examples 5 to 11. A ferrite carrier having the average particle size of 80 μm was then blended with each of the resultant mixtures, and uniformly agitated and mixed to prepare a two-component developer having toner density of 4.0%. With the use of each of the developers thus prepared, the tests above-mentioned and the following test of humidity resistance were conducted.

Test of Humidity Resistance

Each of the toners above-mentioned was checked for the condition of flow from the toner hopper to the developing device at the time when a solid-black document was continuously copied for 20,000 pieces. The toner which was smoothly resupplied without trouble, was evaluated as good (O), while the toner with which the hopper and/or developing device was clogged, was evaluated as bad (X) .

The test results are shown in Tables 2A and 2B.

TABLE 2A

| | I.D. | F.D. | $F_1$ °C. | $F_2$ °C. |
|---|---|---|---|---|
| Example 3 | 1.50 | 0.000 | 145 | 195 |
| Example 4 | 1.48 | 0.000 | 145 | 195 |
| Example 5 | 1.50 | 0.000 | 140 | 190 |
| Comparative Example 5 | 1.52 | 0.003 | 140 | 170 |
| Comparative Example 6 | 1.40 | 0.000 | 170 | 190 |
| Comparative Example 7 | 1.45 | 0.002 | 140 | 175 |
| Comparative Example 8 | 1.50 | 0.000 | 145 | 195 |
| Comparative Example 9 | 1.50 | 0.000 | 140 | 145 |
| Comparative Example 10 | 1.50 | 0.000 | 160 | 195 |
| Comparative Example 11 | 1.40 | 0.000 | 170 | 195 |

TABLE 2B

| | $B_1$°C. | Toner Blanking | "Rainfall" | Humidity Resistance |
|---|---|---|---|---|
| Example 3 | 70 | ○ | ○ | ○ |
| Example 4 | 70 | ○ | ○ | ○ |
| Example 5 | 70 | ○ | ○ | ○ |
| Comparative Example 5 | 60 | X | X | ○ |
| Comparative Example 6 | 70 | ○ | ○ | ○ |
| Comparative Example 7 | 60 | X | X | ○ |
| Comparative Example 8 | 70 | ○ | ○ | X |
| Comparative Example 9 | 65 | X | X | ○ |
| Comparative Example 10 | 65 | X | X | ○ |
| Comparative Example 11 | 70 | ○ | ○ | ○ |

As apparent from Tables 2A and 2B, it was found that each of Comparative Example 5 containing styrene in an amount less than 40% by weight, Comparative Example 7 in which the acid value was less than 20 mg/g, Comparative Example 9 in which the molecular weight of the maximum value $P_H$ was less than $1\times10^5$ and Comparative Example 10 in which the molecular weight of the maximum value $P_L$ exceeded $1\times10^5$, was low in blocking temperature so that there were observed toner blanking and "rainfall" due to blocking. It was also found that each of Comparative Examples 5, 7 and 9 was low in off-set temperature and therefore liable to produce off-set. It was also found that each of Comparative Example 10 and Comparative Examples 6, 11 containing styrene in a content exceeding 80% by weight, was high in lowest fixing temperature and was therefore disadvantageous in low-temperature fixing properties. It was also found that Comparative Example 8 in which the acid value exceeded 50 mg/g, was disadvantageous in humidity resistance. It was also found that, in each of Comparative Examples 5 and 7, the electric charging characteristics became unstable to produce fog. It was also found that, in each of Comparative Examples 6, 7 and 11, the image density was lowered. On the other hand, it was found that each of Examples 3 to 5 in accordance with the present invention was excellent in low-temperature fixing properties and resistance to off-set, as well as resistance to blocking.

We claim:

1. An electrophotographic toner containing, as a fixing resin, a styrene-acrylic copolymer containing styrene in an amount of not less than 80% by weight with respect to the entire amount of said resin and presenting a gel permeation chromatogram of molecular-weight distribution in which the maximum value is located in each of ranges from $2\times10^3$ to $1\times10^4$ and from $1.5\times10^5$ to $1.9\times10^5$, and of which upper limit is $2.1\times10^5$, wherein said styrene-acrylic copolymer comprises a styrene monomer selected from the group consisting of vinyl toluene, α-methylstyrene and styrene and an acrylic monomer having the formula

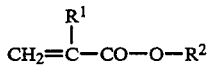

wherein $R^1$ is a hydrogen atom or a lower alkyl group and $R^2$ is a hydrogen atom, a hydrocarbon group having 1 to 12 carbon atoms, a hydroxyalkyl group, a vinylester group, or an aminoalkyl group.

2. The electrophotographic toner according to claim 1, wherein said styrene-acrylic copolymer is styrene-butyl acrylate copolymer.

3. The electrophotographic toner according to claim 1, wherein said acrylic monomer is selected from the group consisting of acrylic acid, methacrylic acid, methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, ethyl β-hydroxyacrylate, propyl gamma-hydroxyacrylate, butyl δ-hydroxyacrylate, ethyl δ-hydroxymethacrylate, propyl gamma-amino-acrylate, propyl gamma-N,N-diethylaminoacrylate, ethylene glycol dimethacrylate, and tetraethylene glycol dimethacrylate.

* * * * *